United States Patent [19]

Rozmus

[11] 3,966,210

[45] June 29, 1976

[54] GOLF CLUB

[76] Inventor: John J. Rozmus, 1030 Derwydd Lane, Berwyn, Pa. 19312

[22] Filed: Feb. 11, 1969

[21] Appl. No.: 798,351

[52] U.S. Cl. ..... 273/169; 273/80 C; 273/167 F; 273/167 G

[51] Int. Cl.[2] ..... A63B 53/04

[58] Field of Search ..... 273/77 R, 80 C, 81 R, 273/81.3, 162 R, 164, 167–175, 193 R, 194 R; D34/5 GH, 5 GC

[56] References Cited

UNITED STATES PATENTS

| | | | |
|---|---|---|---|
| 807,224 | 12/1905 | Vaile | 273/167 X |
| 1,133,129 | 3/1915 | Govan | 273/171 |
| 1,139,985 | 5/1915 | Legh | 273/169 |
| 1,459,810 | 6/1923 | Wills | 273/169 |
| 1,589,926 | 6/1926 | Beamer | 273/167 |
| 1,901,562 | 3/1933 | Main | 273/169 |
| 2,056,335 | 10/1936 | Wettlaufer | 273/171 X |
| 2,954,231 | 9/1960 | MacIntyre | 273/167 G X |
| 3,368,812 | 2/1968 | Baldwin | 273/171 X |
| 3,392,977 | 7/1968 | de Lacey | 273/168 X |
| 3,516,674 | 6/1970 | Scarborough | 273/169 |
| D193,096 | 6/1962 | Green, Jr. | D34/5 |
| D207,228 | 3/1967 | Solheim | D34/5 |
| D212,890 | 12/1968 | Rose | D34/5 |

FOREIGN PATENTS OR APPLICATIONS

| | | | |
|---|---|---|---|
| 827,567 | 1/1938 | France | 273/167 |

OTHER PUBLICATIONS

"Golf World"; Apr. 2, 1965; p. 28.

*Primary Examiner*—Richard J. Apley
*Attorney, Agent, or Firm*—Frederick J. Olsson

[57] ABSTRACT

A gold club (either wood, iron or putter) constructed to cause the striking face to be aligned normal to the line of swing both during the swing and at the instant of impact and also constructed to provide, at the instant of impact, a high moment of inertia with respect to the center line, the alignment and inertia characteristic providing for the ball to be hit straight away without hook or slice.

2 Claims, 7 Drawing Figures

Fig. 1
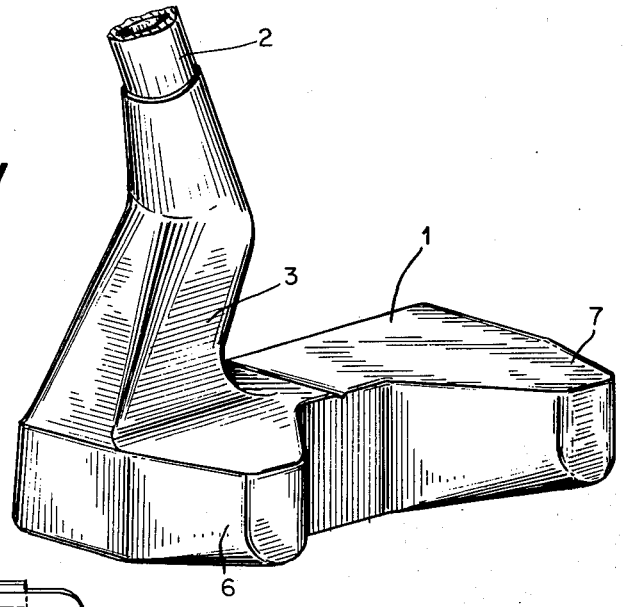
Fig. 2
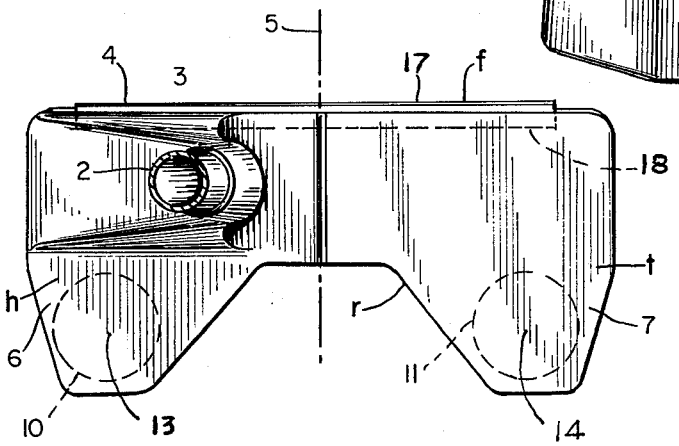
Fig. 4
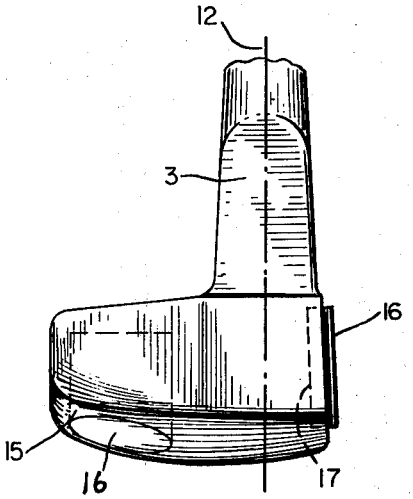
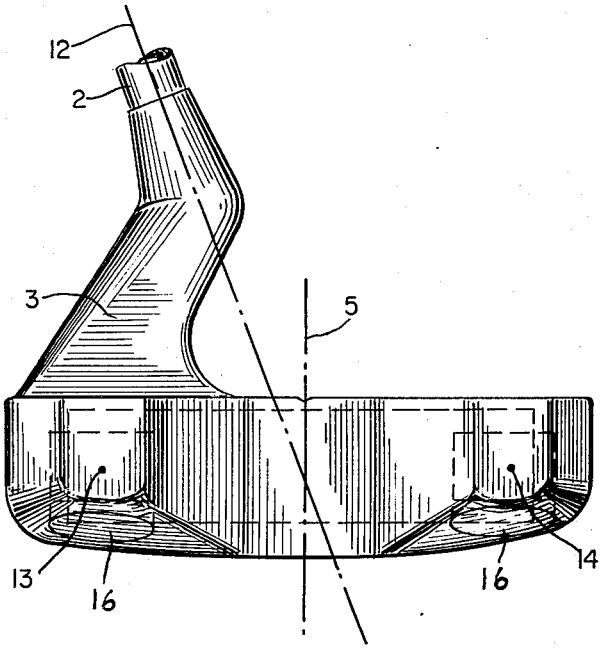
Fig. 3
INVENTOR.
JOHN J. ROZMUS
BY
Frederick J. Olsson
ATTORNEY.

INVENTOR.
JOHN J. ROZMUS

BY Frederick J. Olsson
ATTORNEY.

GOLF CLUB

This invention relates to golf clubs and in particular relates to a club constructed so that the ball is hit square whereby it travels to the target substantially in a straight line without hook, slice or other deviation.

One object of the invention is to provide a golf club having a construction which operates during the swing and also at the moment of impact so that the striking face of the club hits the ball square.

Another object of the invention is to provide a golf club having a shaft whose axis goes through the center line or plane of impact of the head and which has weight concentrations located respectively on opposite sides of the center line substantially outwardly thereof and spaced rearwardly of the shaft, the shaft and weights operating during the swing to cause the head to be oriented with its striking face normal to the line of swing.

Another object of the invention is to provide a golf club having weight concentrations distributed on opposite sides of the center line or impact plane of the head and substantially outwardly therefrom to provide a high moment of inertia with respect to the center line and thereby minimize twist of the striking face in the event the ball is hit off-center.

Another object of the invention is to provide a golf club having a shaft whose axis goes through the center line or plane of impact of the head and having weight concentrations respectively on opposite sides of the center line substantially outwardly thereof and spaced rearwardly of the shaft, the shaft and the weights operating to provide a high moment of inertia with respect to the center line at the moment of impact and thereby minimizing any twisting of the striking face in the event the ball is hit off-center.

Another object of the invention is to provide a golf club having a striking face which is substantially frictionless so as to avoid imparting a lateral spin to the ball if the club face is not normal to the line of swing and also to prevent forward sliding of the ball at the moment of impact.

Typical embodiments of the invention in the form of a putter and a driving wood will be explained below in connection with the following drawings wherein:

FIG. 1 is a perspective view of a putter constructed in accordance with the invention.

FIG. 2 is a plan view of the putter of FIG. 1.

FIG. 3 is a view looking toward the rear in FIG. 2.

FIG. 4 is a side elevational view of the putter of FIG. 2.

Figure 5:
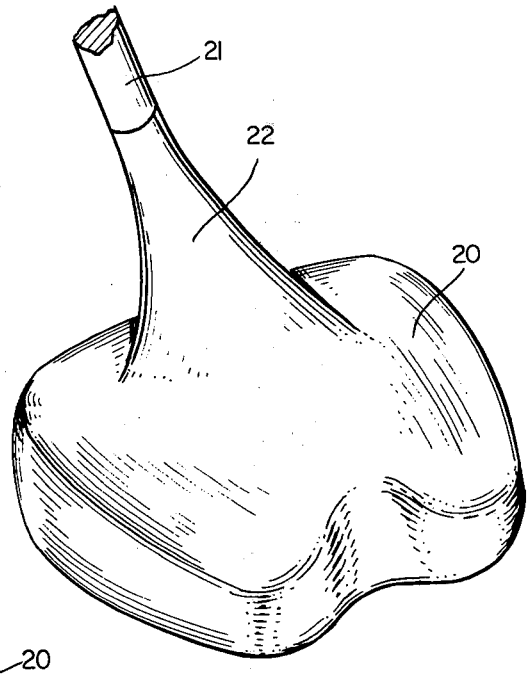
FIG. 5 is a perspective view of a driver constructed in accordance with the invention.

In FIG. 1 the head of the putter is indicated at 1, the shaft at 2 and the shank or means connecting the shaft with the head at 3. In FIG. 2 the heel of the club is designated by *h*, the toe by *t* and the front side by *f* and the rear side by *r*. Means forming the ball striking face of the putter is indicated at 4. The center line of the head or the plane of impact (which contains the center line) is indicated at 5. Generally the plane 5 is normal to the striking face 4 or if the surface is tapered or otherwise contoured, the plane would go through the center of the surface.

The putter is preferably of unitary construction and has wings 6 and 7 which are respectively disposed on opposite sides of the plane 5 and within which are disposed weights 10 and 11. Referring to FIG. 3 it will be seen that the projection of the shaft axis 12 goes through the center line or the plane of impact 5. Taking into account the means 3 for connecting the shaft, the symmetry of the head and the weights 10 and 11, the construction provides for equal weight distribution on opposite sides of the plane 5. The mass concentrations can be considered as being located at the points 13 and 14. The invention contemplates the attaining of the aforesaid mass concentrations by making the head homogenous and hollowing out the central portion so as to leave the mass concentrations at the tips of the wings.

The points 13 and 14 are equi-distant from and spaced substantially outwardly from the plane 5 and also spaced substantially to the rear of the striking face 4 and the shaft 2.

The weights 10 and 11 are held in cavities in the head preferably with an epoxy resin and the cavities are filled with an impact resisting potting material 16. With reference to FIG. 4 it will be noted that the bottom portion 15 of the club head is tapered somewhat upwardly. I have found this useful to prevent rubbing of the putter on the green in cases where the player tends to rotate the club upwardly after impact.

The striking face 4 is comprised of material to provide a substantially friction free surface, the frictionless characteristic being isotropic. Preferably, the face is made from a teflon strip 17 held in a cavity 18 by suitable mastic. In the putter arrangement the surface 4 has a slight loft, preferably being oriented 4° to the vertical (see FIG. 4).

The basic structure described above as applied to a driver is shown in FIGS. 5 through 7. Before commenting on the driver, it is pointed out that the same basic configuration can be applied not only to a putter and a driver, but also to any of the irons, the loft of the striking surface being made to suit the type of club.

Figure 6:
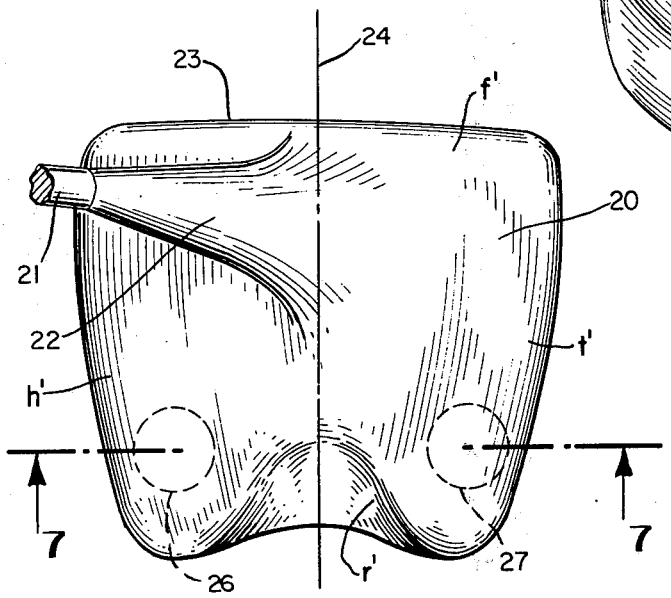
FIG. 6 is a plan view of the driver of FIG. 5.
Figure 7:
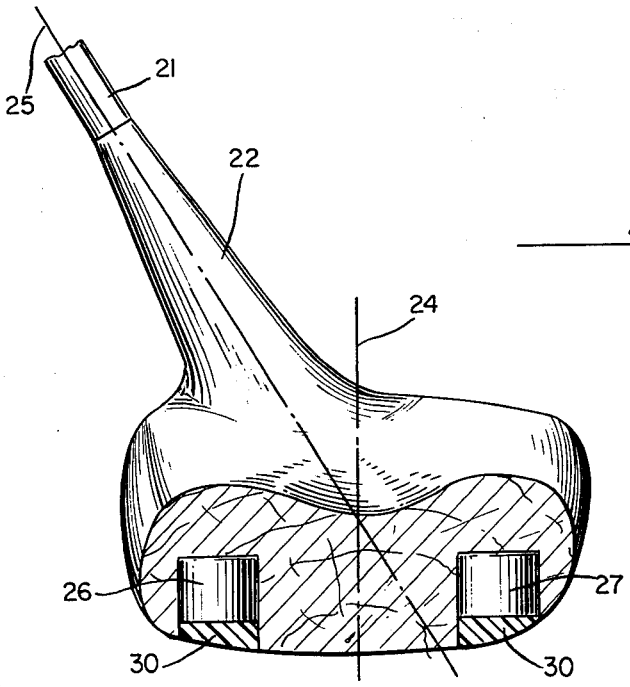
FIG. 7 is a sectional elevational view taken along the lines 7—7 of FIG. 6.

In FIGS. 5 and 6 the body of the driver is indicated at 20, the shaft at 21 and the shank at 22. The striking face of the driver is indicated at 23. The heel of the driver is designated by $h'$, the toe by $t'$, the front side by $f'$ and the rear side by $r'$. The plane of impact or center line of the head 24 is symmetrical with respect to the face 23. With reference to FIG. 7 it will be seen that the projection of the shaft axis 25 intersects the center line or plane of impact 24.

The head has weights 26 and 27 which provide for mass concentrations disposed respectively on opposite sides of the center line 24. With reference to FIG. 7 the weights 26 and 27 are held in cavities preferably with epoxy resin and the cavities are filled with impact resisting potting material 30.

Similar to the putter described above, the mass concentrations of the driver are equi-distant and spaced substantially outwardly from the plane 24 and also spaced substantially to the rear of the striking face 23 and shaft 21. While in the driver arrangement I have not shown the striking face 23 to be friction free, the invention contemplates that the driver has such structure.

Having described the structure of a typical putter and driver, certain advantages of the same will next be commented on.

The friction free face is of importance in a golf club in that it minimizes the tendency for the striking face to impart a lateral spin and hence minimizes or eliminates hooking and slicing. For example, if the club face is not substantially normal to the line of swing, the tendency of the face would be to impart a lateral spin to the ball. This tendency is augmented where the surface is of conventional form in that a high degree of friction is present. By making the face substantially friction free there is little, if any, force available to cause the lateral spin. The reduction or elimination of lateral spin, of course, is important in any type of golf club.

The friction free face has further and special importance in putters in that it minimizes or eliminates sliding of the ball upon impact. In a conventional putter, the surface of the face is not substantially friction free and upon impact the friction retards the spinning of the ball and therefore the same slides or hops. With the frictionless face, the ball is not retarded and therefore immediately partakes of a rolling action. This, of course, enhances directional accuracy and control.

Arranging the shaft so that its axis intersects the center line or plane of impact, locating of the mass concentrations on opposite sides of the center line substantially outwardly thereof and substantially to the rear of the shaft has important special advantage both during the swing and at the moment of impact.

During the swing if the face of the club face is twisted or not normal to the line of swing, the mass concentrations, by trailing the shaft or the point of moving force application will cause a torque to be set up with respect to the shaft which tends to rotate the head until the face is normal. This is of special advantage in that the player can take a relaxed grip on the shaft with assurances that at the instant of impact, the face is properly aligned, i.e., normal to the line of swing. This is of special importance for direction control in that with such a square hit the ball will fly straight out in the same direction as the line of swing.

At the moment of impact the weight concentrations provide a substantially high moment of inertia with respect to the center line or plane of impact. Thus, if the ball is struck slightly off center, the inertia of the head is such that the face remains aligned normal to the line of swing. An off center strike will have minimum effect in causing twist or cant of the striking face and therefore minimize the likelihood of the face imparting a lateral spin to the ball. This is highly advantageous in that hooking or slicing of the ball is minimized or even eliminated.

Before closing, it is pointed out that the alighment and the inertia structure and the frictionless striking face have a special cooperative relationship particularly in that both contribute to the important objective of minimizing or practically eliminating lateral spin.

I claim:

1. In a golf club:

a head with heel and toe sections and front and rear sides;

a ball striking face formed on the front side with the plane of impact of the head being located between the heel and toe sections and being generally normal to the striking face;

a shaft connected to the head with the projection of the shaft axis extending through the plane of impact;

means on the head forming weight means respectively disposed on opposite sides of the plane of impact and whose mass concentrations are located substantially outwardly from the plane of impact respectively toward the heel and toe sections and also substantially spaced from the projection of the shaft axis in a rearward direction, said disposition of the shaft axis and the location of the mass concentrations being for use in causing the striking face, during the swing, to be oriented generally normal to the line of swing and for use in providing for the head to have, at the moment of ball impact, a high moment of inertia with respect to the plane of impact so as to minimize twist of the striking face; and said mass concentrations being substantially formed by that the head is formed with a pair of wings respectively disposed on opposite sides of the plane of impact and that there are weights respectively in said wings.

2. In a golf club:

a head with heel and toe sections and front and rear sides;

a ball striking face formed on the front side with the plane of impact of the head being located between the heel and toe sections and being generally normal to the striking face;

a shaft connected to the head with the projection of the shaft axis extending through the plane of impact;

means on the head forming weight means respectively disposed on opposite sides of the plane of impact and whose mass concentrations are located substantially outwardly from the plane of impact respectively toward the heel and toe sections and also substantially spaced from the projection of the shaft axis in a rearward direction, said disposition of the shaft axis and the location of the mass concentrations being for use in causing the striking face, during the swing to be oriented generally normal to the line of swing and for use in providing for the head to have, at the moment of ball impact, a high moment of inertia with respect to the plane of impact so as to minimize twist of the striking face; and said mass concentrations being substantially formed by a pair of weights in said head.

* * * * *

REEXAMINATION CERTIFICATE (1580th)

United States Patent [19]

Rozmus

[11] B1 3,966,210

[45] Certificate Issued Oct. 29, 1991

[54] GOLF CLUB

[76] Inventor: John J. Rozmus, 1030 Derwydd La., Berwyn, Pa. 19312

Reexamination Request:
No. 90/001,424, Jan. 20, 1988

Reexamination Certificate for:

| | |
|---|---|
| Patent No.: | **3,966,210** |
| Issued: | **Jun. 29, 1976** |
| Appl. No.: | **798,351** |
| Filed: | **Feb. 11, 1969** |

[51] Int. Cl.[5] ..... A63B 53/04

[52] U.S. Cl. ..... 273/169; 273/80 C; 273/167 F; 273/167 G

[58] Field of Search ..... 273/77 R, 80 C, 81 R, 273/81.3, 162 R, 164, 167–175, 193 R, 194 R

[56] References Cited

U.S. PATENT DOCUMENTS

| | | | |
|---|---|---|---|
| 1,459,810 | 6/1923 | Wills | 273/169 |
| 1,518,316 | 12/1924 | Ellingham | 273/171 |
| 2,708,579 | 5/1955 | Hugman | 273/79 |
| 2,781,197 | 2/1957 | Wiley | 273/164 |
| 3,143,349 | 8/1964 | MacIntyre | 273/171 |
| 3,374,027 | 3/1968 | Jacobs | 273/162 E |
| 3,516,674 | 6/1970 | Scarborough | 273/169 |
| 3,966,210 | 6/1976 | Rozmus | 273/169 |

*Primary Examiner*—George J. Marlo
*Attorney, Agent, or Firm*—Frederick J. Olsson

[57] ABSTRACT

A golf club (either wood, iron or putter) constructed to cause the striking face to be aligned normal to the line of swing both during the swing and at the instant of impact and also constructed to provide, at the instant of impact, a high moment of inertia with respect to the center line, the alignment and inertia characteristic providing for the ball to be hit straight away without hook or slice.

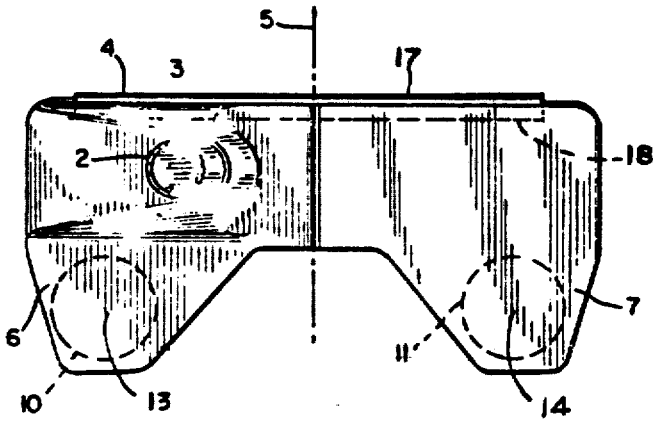

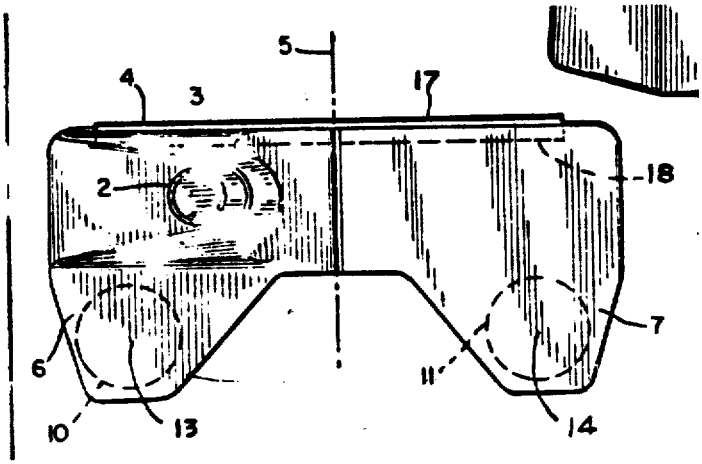
5
4
3
17
2
18
7
6
11
10
13
14

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1 and 2 having been finally determined to be unpatentable, are cancelled.

* * * * *